US010210829B2

(12) United States Patent
Baek et al.

(10) Patent No.: US 10,210,829 B2
(45) Date of Patent: Feb. 19, 2019

(54) DISPLAY APPARATUS AND METHOD OF OPERATION

(71) Applicant: SAMSUNG DISPLAY CO., LTD., Yongin-si, Gyeonggi-Do (KR)

(72) Inventors: Yun-Ki Baek, Suwon-si (KR); Yong-Jun Jang, Yongin-si (KR); Nam-Gon Choi, Yongin-si (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 249 days.

(21) Appl. No.: 15/175,456

(22) Filed: Jun. 7, 2016

(65) Prior Publication Data

US 2017/0116941 A1 Apr. 27, 2017

(30) Foreign Application Priority Data

Oct. 27, 2015 (KR) ..... 10-2015-0149593

(51) Int. Cl.
*G09G 3/36* (2006.01)
*G09G 3/20* (2006.01)

(52) U.S. Cl.
CPC ..... *G09G 3/3648* (2013.01); *G09G 3/2044* (2013.01); *G09G 3/3614* (2013.01); *G09G 2310/08* (2013.01); *G09G 2320/0285* (2013.01)

(58) Field of Classification Search
CPC . G09G 3/2007; G09G 3/2044; G09G 2310/08
USPC ..... 345/99
See application file for complete search history.

(56) References Cited

U.S. PATENT DOCUMENTS

2010/0109992 A1* 5/2010 Sumi ..... G09G 3/3648 345/89
2012/0154428 A1 6/2012 Barnhoefer
2013/0155319 A1* 6/2013 Enenkl ..... G09G 3/2044 348/441
2015/0098120 A1* 4/2015 Ji ..... G09G 5/02 359/261

* cited by examiner

*Primary Examiner* — Roy P Rabindranath
(74) *Attorney, Agent, or Firm* — F. Chau & Associates, LLC

(57) ABSTRACT

A display apparatus includes a display panel including a first pixel, a common voltage generator and a timing controller. The common voltage generator generates a reference common voltage, and provides the reference common voltage to the first pixel. The timing controller determines a dithering scheme for the first pixel based on first common voltage information, and generates first output pixel data by applying a dithering function to first input pixel data based on the dithering scheme for the first pixel. The first common voltage information indicates whether the reference common voltage is substantially equal to an optimal common voltage of the first pixel. A first data voltage provided to the first pixel is generated based on the first output pixel data. A polarity of the first data voltage is reversed with respect to the reference common voltage for each predetermined duration. A phase of the first data voltage is symmetric or asymmetric with respect to the reference common voltage depending on the dithering scheme for the first pixel.

20 Claims, 10 Drawing Sheets

LUT1

| INPUT GRAYSCALE | TARGET GRAYSCALE | COMMON VOLTAGE INFORMATION |
|---|---|---|
| 0 | 0 | NORD |
| 1 | 1.25 | POSD |
| 2 | 2.5 | POSD |
| 3 | 2.75 | POSD |
| ⋮ | ⋮ | ⋮ |
| 127 | 127.25 | NEGD |
| 128 | 128.5 | NEGD |
| 129 | 128.75 | NEGD |
| ⋮ | ⋮ | ⋮ |
| 255 | 255 | NORD |

DISPLAY APPARATUS AND METHOD OF OPERATION

CROSS-REFERENCE TO RELATED APPLICATION

This application claims priority under 35 USC § 119 to Korean Patent Application No. 10-2015-0149593, filed on Oct. 27, 2015 in the Korean Intellectual Property Office (KIPO), the contents of which are herein incorporated by reference in their entirety.

TECHNICAL FIELD

Exemplary embodiments relate generally to displaying images, and more particularly to display apparatuses and methods of operating the display apparatuses.

DISCUSSION OF RELATED ART

Generally, a liquid crystal display (LCD) apparatus includes a first substrate including a pixel electrode, a second substrate including a common electrode, and a liquid crystal layer disposed between the first and second substrates. An electric field is generated by voltages applied to the pixel electrode and the common electrode. Transmittance of light passing through the liquid crystal layer may be controlled by adjusting the electric field formed therein, and thus, a desired image may be displayed.

When an electric field having a uniform direction is continuously applied to the liquid crystal layer, a characteristic of the liquid crystal may be degraded. To prevent such degradation, the polarity of a data voltage applied to a pixel of the LCD apparatus can be reversed periodically.

In the LCD apparatus, an optimal common voltage level applied to the common electrode may vary depending on a grayscale of an image and/or a location to which a common voltage is applied. A flicker, which is a flashing effect displeasing to human eyes, can occur on the LCD apparatus due to such variance of the optimal common voltage level and can be recognized as a display defect.

SUMMARY OF THE INVENTION

An exemplary embodiment display apparatus and method of operation are described herein.

At least one exemplary embodiment of the present disclosure provides a display apparatus capable of substantially preventing flicker to provide high display quality.

At least one exemplary embodiment of the present disclosure provides a method of operating the display apparatus.

According to an exemplary embodiment, a display apparatus includes a display panel, a common voltage generator and a timing controller. The display panel includes a first pixel. The common voltage generator generates a reference common voltage, and provides the reference common voltage to the first pixel. The timing controller determines a dithering scheme for the first pixel based on first common voltage information, and generates first output pixel data by applying a dithering function to first input pixel data based on the dithering scheme for the first pixel. The first common voltage information indicates whether the reference common voltage is substantially equal to an optimal common voltage of the first pixel. A first data voltage provided to the first pixel is generated based on the first output pixel data. A polarity of the first data voltage is reversed with respect to the reference common voltage for each predetermined duration. A phase of the first data voltage is symmetric or asymmetric with respect to the reference common voltage depending on the dithering scheme for the first pixel.

In an exemplary embodiment, when the optimal common voltage of the first pixel is different from the reference common voltage, the timing controller may set the dithering scheme for the first pixel to one of a first dithering scheme or a second dithering scheme. When the first data voltage is generated based on one of the first or second dithering schemes, the phase of the first data voltage may be asymmetric with respect to the reference common voltage.

In an exemplary embodiment, when the optimal common voltage of the first pixel is higher than the reference common voltage, the first dithering scheme may be set as the dithering scheme for the first pixel. The first data voltage generated based on the first dithering scheme may have a first positive polarity level during a first frame, a first negative polarity level during a second frame subsequent to the first frame, the first positive polarity level during a third frame subsequent to the second frame, and the first negative polarity level during a fourth frame subsequent to the third frame. The first positive polarity level may correspond to a first grayscale, and the first negative polarity level may correspond to a second grayscale lower than the first grayscale.

In an exemplary embodiment, the display panel may further include a second pixel adjacent to the first pixel. When the first dithering scheme is set as the dithering scheme for the first pixel, the first dithering scheme may also be set as a dithering scheme for the second pixel. A second data voltage provided to the second pixel may be generated based on the first dithering scheme. The second data voltage may have the first negative polarity level during the first frame, the first positive polarity level during the second frame, the first negative polarity level during the third frame, and the first positive polarity level during the fourth frame.

In an exemplary embodiment, when the optimal common voltage of the first pixel is lower than the reference common voltage, the second dithering scheme may be set as the dithering scheme for the first pixel. The first data voltage generated based on the second dithering scheme may have a first positive polarity level during a first frame, a first negative polarity level during a second frame subsequent to the first frame, the first positive polarity level during a third frame subsequent to the second frame, and the first negative polarity level during a fourth frame subsequent to the third frame. The first positive polarity level may correspond to a first grayscale, and the first negative polarity level may correspond to a second grayscale higher than the first grayscale.

In an exemplary embodiment, when the optimal common voltage of the first pixel is substantially equal to the reference common voltage, the timing controller may set the dithering scheme for the first pixel to a third dithering scheme. When the first data voltage is generated based on the third dithering schemes, the phase of the first data voltage may be symmetric with respect to the reference common voltage.

In an exemplary embodiment, the first data voltage generated based on the third dithering scheme may have a first positive polarity level during a first frame, a first negative polarity level during a second frame subsequent to the first frame, a second positive polarity level during a third frame subsequent to the second frame, and a second negative polarity level during a fourth frame subsequent to the third frame. Each of the first positive polarity level and the second negative polarity level may correspond to a first grayscale, and each of the first negative polarity level and the second positive polarity level may correspond to a second grayscale lower than the first grayscale.

In an exemplary embodiment, the first data voltage generated based on the third dithering scheme may have a first positive polarity level during a first frame, a first negative polarity level during a second frame subsequent to the first frame, a second positive polarity level during a third frame subsequent to the second frame, and a second negative polarity level during a fourth frame subsequent to the third frame. Each of the first positive polarity level and the first negative polarity level may correspond to a first grayscale, and each of the second positive polarity level and the second negative polarity level may correspond to a second grayscale lower than the first grayscale.

In an exemplary embodiment, wherein the timing controller may include a grayscale compensator, a dithering controller and a dithering processor. The grayscale compensator may generate a first target grayscale based on a first grayscale corresponding to the first input pixel data. The dithering controller may generate a first dithering signal based on the first grayscale and the first common voltage information. The first dithering signal may indicate the dithering scheme for the first pixel. The dithering processor may generate the first output pixel data by combining the first grayscale and a second grayscale based on the first dithering signal. The first target grayscale may be represented based on a combination of the first and second grayscales.

In an exemplary embodiment, a relationship of the first grayscale, the first target grayscale and the first common voltage information may be stored as a lookup table.

In an exemplary embodiment, the first common voltage information may be generated based on flicker levels that are obtained by an external flicker measurement device.

In an exemplary embodiment, the first common voltage information may be changed depending on a first grayscale corresponding to the first input pixel data.

In an exemplary embodiment, the first common voltage information may be changed depending on a location of the first pixel in the display panel.

According to an exemplary embodiment method of operating a display apparatus, a reference common voltage is generated. A dithering scheme for a first pixel is determined based on first common voltage information. The first pixel is included in a display panel. The first common voltage information indicates whether the reference common voltage is substantially equal to an optimal common voltage of the first pixel. First output pixel data is generated by applying a dithering function to first input pixel data based on the dithering scheme for the first pixel. A first data voltage is generated based on the first output pixel data. The reference common voltage and the first data voltage are provided to the first pixel. A polarity of the first data voltage is reversed with respect to the reference common voltage for each predetermined duration. A phase of the first data voltage is symmetric or asymmetric with respect to the reference common voltage depending on the dithering scheme for the first pixel.

In an exemplary embodiment, when the optimal common voltage of the first pixel is different from the reference common voltage, the dithering scheme for the first pixel may be set to one of a first dithering scheme and a second dithering scheme. When the first data voltage is generated based on one of the first and second dithering schemes, the phase of the first data voltage may be asymmetric with respect to the reference common voltage.

In an exemplary embodiment, when the optimal common voltage of the first pixel is higher than the reference common voltage, the first dithering scheme may be set as the dithering scheme for the first pixel. The first data voltage generated based on the first dithering scheme may have a first positive polarity level during a first frame, a first negative polarity level during a second frame subsequent to the first frame, the first positive polarity level during a third frame subsequent to the second frame, and the first negative polarity level during a fourth frame subsequent to the third frame. The first positive polarity level may correspond to a first grayscale, and the first negative polarity level may correspond to a second grayscale lower than the first grayscale.

In an exemplary embodiment, when the optimal common voltage of the first pixel is lower than the reference common voltage, the second dithering scheme may be set as the dithering scheme for the first pixel. The first data voltage generated based on the second dithering scheme may have a first positive polarity level during a first frame, a first negative polarity level during a second frame subsequent to the first frame, the first positive polarity level during a third frame subsequent to the second frame, and the first negative polarity level during a fourth frame subsequent to the third frame. The first positive polarity level may correspond to a first grayscale, and the first negative polarity level may correspond to a second grayscale higher than the first grayscale.

In an exemplary embodiment, when the optimal common voltage of the first pixel is substantially equal to the reference common voltage, the dithering scheme for the first pixel may be set to a third dithering scheme. When the first data voltage is generated based on the third dithering schemes, the phase of the first data voltage may be symmetric with respect to the reference common voltage.

In an exemplary embodiment, the first common voltage information may be changed depending on a first grayscale corresponding to the first input pixel data.

In an exemplary embodiment, the first common voltage information may be changed depending on a location of the first pixel in the display panel.

In an exemplary embodiment, the dithering scheme is selected from the group comprising a symmetric dithering scheme, an asymmetric positive dithering scheme, and an asymmetric negative dithering scheme, wherein the symmetric dithering scheme is for use when the stored optimal common voltage is substantially equal to the reference common voltage, the asymmetric positive dithering scheme is for use when the stored optimal common voltage is greater than the reference common voltage, and the asymmetric negative dithering scheme is for use when the stored optimal common voltage is less than the reference common voltage.

In an exemplary embodiment, the dithering scheme comprises one of a temporal per pixel dithering, a spatial multi-pixel dithering, or a hybrid temporal per pixel dithering and spatial multi-pixel dithering.

According to an exemplary embodiment method of manufacturing a display apparatus, the method includes: driving a plurality of pixels in the display apparatus with a plurality of test patterns; measuring flicker generated by the plurality of pixels while displaying each of the plurality of the test patterns; determining optimal voltage information for the plurality of pixels based on the measured flicker; and storing the determined optimal voltage information in a look-up table for use in a plurality of dithering schemes.

In an exemplary embodiment, the plurality of dithering schemes includes symmetric dithering for use when the stored optimal voltage is substantially equal to a reference voltage, asymmetric positive dithering for use when the stored optimal voltage is greater than the reference voltage, and asymmetric negative dithering for use when the stored optimal voltage is less than the reference voltage.

In an exemplary embodiment, the dithering scheme comprises one of a temporal per pixel dithering, a spatial multi-pixel dithering, or a hybrid temporal per pixel dithering and spatial multi-pixel dithering.

In a display apparatus according to an exemplary embodiment, a dithering scheme may be determined based on whether the reference common voltage is substantially equal to the optimal common voltage, and the dithering function may be applied to the input pixel data based on the determined dithering scheme. The data voltage of which the phase is symmetric with respect to the optimal common voltage may be efficiently generated even if the reference common voltage is not equal to the optimal common voltage. Accordingly, the flicker may be reduced on the display panel, and the display apparatus may have a high display quality.

BRIEF DESCRIPTION OF THE DRAWINGS

Illustrative, non-limiting exemplary embodiments will be more clearly understood from the following detailed description taken in conjunction with the accompanying drawings, in which.

DETAILED DESCRIPTION OF THE DRAWINGS

Figure 1:
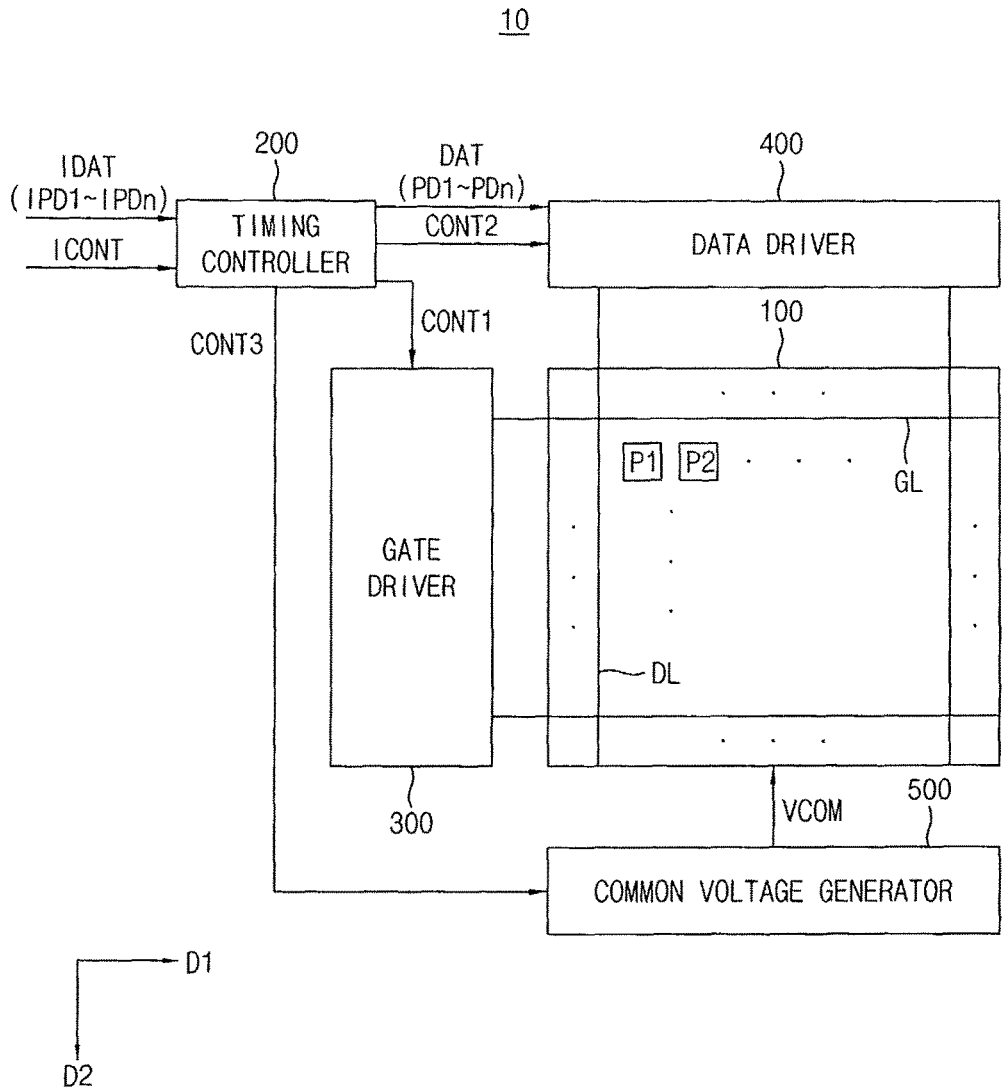
FIG. 1 is a block diagram illustrating a display apparatus according to an exemplary embodiment.

The present inventive concept will be described more fully with reference to the accompanying drawings, in which exemplary embodiments are shown. This inventive concept may, however, be embodied in many different forms and should not be construed as being limited to the embodiments set forth herein. Like reference numerals may refer to like elements throughout this application.

FIG. 1 is a block diagram illustrating a display apparatus according to an exemplary embodiment.

Referring to FIG. 1, a display apparatus 10 includes a display panel 100, a timing controller 200, a gate driver 300 connected between the timing controller and the display panel, a data driver 400 connected between the timing controller and the display panel, and a common voltage generator 500 connected between the timing controller and the display panel.

The display panel 100 operates (e.g., displays an image) based on output image data DAT. The display panel 100 is connected to a plurality of gate lines GL and a plurality of data lines DL. The gate lines GL may extend in a first direction D1, and the data lines DL may extend in a second direction D2 crossing (e.g., substantially perpendicular to) the first direction D1. The display panel 100 may include a plurality of pixels (e.g., pixels P1 and P2) that are arranged in a matrix form. Each pixel (e.g., the pixel P1) may be electrically connected to a respective one of the gate lines GL and a respective one of the data lines DL.

The timing controller 200 controls an operation of the display panel 100, and controls operations of the gate driver 300, the data driver 400 and the common voltage generator 500. The timing controller 200 receives input image data IDAT and an input control signal ICONT from an external device (e.g., a host or a graphics processor). The input image data IDAT may include a plurality of input pixel data IPD1~IPDn for the plurality of pixels. The input control signal ICONT may include a master clock signal, a data enable signal, a vertical synchronization signal, a horizontal synchronization signal, etc.

The timing controller 200 generates the output image data DAT based on the input image data IDAT. The output image data DAT may include a plurality of output pixel data PD1~PDn for the plurality of pixels. The timing controller 200 generates a first control signal CONT1 based on the input control signal ICONT. The first control signal CONT1 may be provided to the gate driver 300, and a driving timing of the gate driver 300 may be controlled based on the first control signal CONT1. The first control signal CONT1 may include a vertical start signal, a gate clock signal, etc. The timing controller 200 generates a second control signal CONT2 based on the input control signal ICONT. The second control signal CONT2 may be provided to the data driver 400, and a driving timing of the data driver 400 may be controlled based on the second control signal CONT2. The second control signal CONT2 may include a horizontal start signal, a data clock signal, a data load signal, a polarity control signal, etc. The timing controller 200 generates a third control signal CONT3 based on the input control signal ICONT. The third control signal CONT3 may be provided to the common voltage generator 500, and a driving timing of the common voltage generator 500 may be controlled based on the third control signal CONT3.

The gate driver 300 generates a plurality of gate signals for driving the gate lines GL based on the first control signal CONT1. The gate driver 300 may sequentially provide the gate signals to the gate lines GL. For example, the gate driver 300 may include a plurality of shift registers (not illustrated).

The data driver 400 generates a plurality of analog data voltages based on the second control signal CONT2 and the digital output image data DAT. The data driver 400 may sequentially provide the data voltages to the data lines DL. For example, the data driver 400 may include a shift register (not illustrated), a latch (not illustrated), a signal processor (not illustrated) and a buffer (not illustrated).

The common voltage generator 500 generates a reference common voltage VCOM based on the third control signal CONT3. The common voltage generator 500 may provide the reference common voltage VCOM to the display panel 100. The display panel 100 may be further connected to at least one common line (not illustrated) for providing the reference common voltage VCOM.

In an exemplary embodiment, the gate driver 300, the data driver 400 and/or the common voltage generator 500 may be disposed, e.g., directly mounted, on the display panel 100, or may be connected to the display panel 100 in a tape carrier package (TCP) type. Alternatively, the gate driver 300, the data driver 400 and/or the common voltage generator 500 may be integrated on the display panel 100.

In the display apparatus 10 according to an exemplary embodiment, the timing controller 200 generates the output pixel data PD1~PDn by applying a dithering function to the input pixel data IPD1~IPDn. The data driver 400 generates the data voltages, and a polarity of each data voltage is reversed with respect to the reference common voltage VCOM for each predetermined duration (or at every predetermined period). In other words, the display apparatus 10 and the display panel 100 operate based on an inversion driving scheme, and a characteristic of a liquid crystal in the display panel 100 might be preserved due to the inversion driving scheme. For example, the display panel 100 may have a polarity pattern of a dot or diagonal inversion where a single pixel is bordered on its top, bottom, left and right by pixels having a polarity opposite to that of the single pixel. For another example, the display panel 100 may have a polarity pattern of a line inversion (e.g., a column inversion or a row inversion) where pixels in a single column or row have the same polarity as each other.

In the timing controller 200 according to an exemplary embodiment, a dithering scheme for the display panel 100 for each pixel is determined based on whether the reference common voltage VCOM is greater, less, or substantially equal to an optimal common voltage of the display panel 100 or each pixel. The dithering function is applied to the input pixel data IPD1~IPDn based on the determined dithering scheme. For example, the dithering scheme may include an asymmetric dithering scheme where a phase of a data voltage is asymmetric with respect to the reference common voltage VCOM, and a symmetric dithering scheme where a phase of a data voltage is symmetric with respect to the reference common voltage VCOM.

Hereinafter, an operation of the display apparatus 10 according to an exemplary embodiment will be described in detail based on one pixel (e.g., P1 in FIG. 1) or two adjacent pixels (e.g., P1 and P2 in FIG. 1) in the display panel 100.

Figure 2:
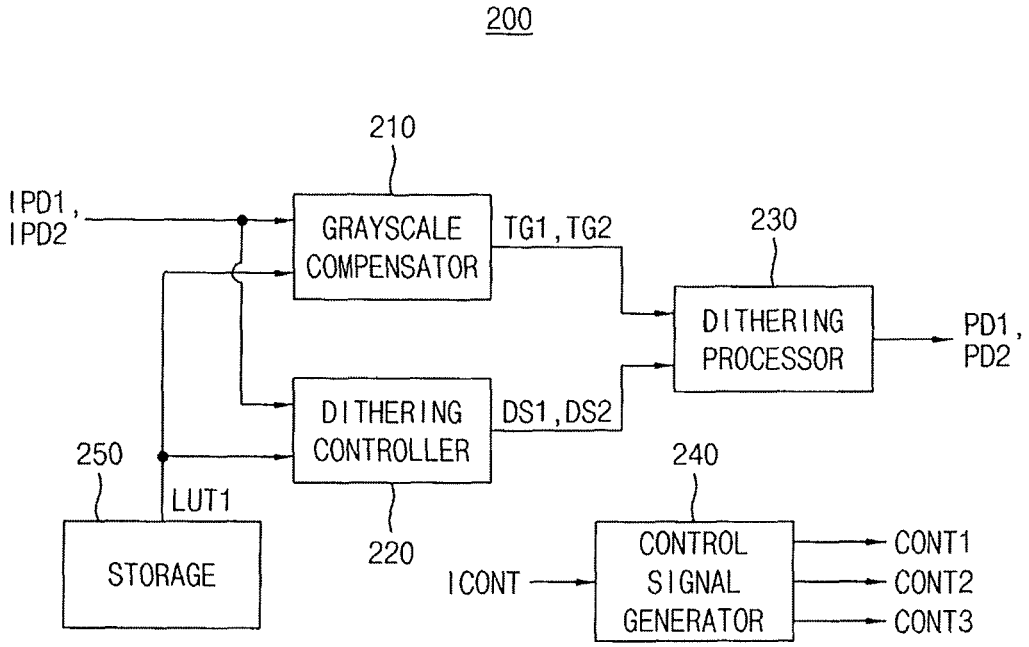
FIG. 2 is a block diagram illustrating a timing controller included in the display apparatus of FIG. 1.

FIG. 2 is a block diagram illustrating a timing controller included in the display apparatus according to an exemplary embodiment.

Referring to FIGS. 1 and 2, a timing controller 200 may include a grayscale compensator 210 connected to input pixel data IPD1 and IPD2, a dithering controller 220 connected to the input pixel data IPD1 and IPD2, and a dithering processor 230 connected to each of the grayscale compensator and the dithering controller. The timing controller 200 may further include a control signal generator 240 connected to input control signal ICONT, and storage 250 connected to each of the grayscale compensator and the dithering controller. Although the timing controller 200 of FIG. 2 is divided into five elements for convenience of explanation, alternate embodiment timing controllers need not be physically divided.

The grayscale compensator 210 may generate a first target grayscale TG1 based on a first grayscale that corresponds to first input pixel data IPD1 of the first pixel P1. The first grayscale may be a grayscale that can be represented without the dithering function, and the first target grayscale TG1 may be a grayscale that can be represented based on the dithering function. For example, it may be assumed that the display panel 100 displays two-hundred-fifty-six grayscales, which range from about 0 grayscale to about 255 grayscale, where the first grayscale may be an integer grayscale (e.g., about 128 grayscale) that is one of the two-hundred-fifty-six grayscales, and the first target grayscale TG1 may be a real number grayscale (e.g., about 128.5 grayscale) that is between two adjacent integer grayscales of the two-hundred-fifty-six grayscales.

The dithering controller 220 may generate a first dithering signal DS1 based on the first grayscale and first common voltage information. The first dithering signal DS1 may indicate a dithering scheme for the first pixel P1. The first common voltage information may indicate whether the reference common voltage VCOM is substantially equal to an optimal common voltage of the first pixel P1. As described below with reference to FIG. 12, the first common voltage information may be generated based on flicker levels that are obtained when the display apparatus 10 is manufactured.

During manufacture of a display apparatus, the manufacturing method may include driving a plurality of pixels in the display apparatus with test patterns; measuring flicker generated by the plurality of pixels while displaying the test patterns; determining optimal common voltage information for the plurality of pixels based on the measured flicker; and storing the determined optimal common voltage information in a look-up table (LUT) for use in a plurality of dithering schemes. The plurality of dithering schemes may include symmetric dithering for use when the stored optimal common voltage is substantially equal to a reference common voltage, positive asymmetric dithering for use when the stored optimal common voltage is greater than a reference common voltage, and negative asymmetric dithering for use when the stored optimal common voltage is less than a reference common voltage.

In an exemplary embodiment, a relationship of the first grayscale, the first target grayscale TG1 and the first common voltage information may be stored as a lookup table. For example, the storage 250 may store a first lookup table LUT1. The first lookup table LUT1 may include a plurality of input grayscales, a plurality of target grayscales corresponding to the input grayscales, and common voltage information for the input grayscales. The first lookup table LUT1 may be provided from the storage 250 to the grayscale compensator 210 and the dithering controller 220. The grayscale compensator 210 and the dithering controller 220 may obtain the first target grayscale TG1 and the first common voltage information, respectively, by searching the first lookup table LUT1.

In an exemplary embodiment, the storage 250 may include, for example, at least one nonvolatile memory such as an erasable programmable read-only memory (EPROM), an electrically erasable programmable read-only memory (EEPROM), a flash memory, a phase-change random access memory (PRAM), a resistance random access memory (RRAM), a magnetic random access memory (MRAM), a ferroelectric random access memory (FRAM), a nano floating gate memory (NFGM), a polymer random access memory (PoRAM), etc. In an exemplary embodiment, the storage 250 may be disposed outside the timing controller 200.

The dithering processor 230 may generate first output pixel data PD1 by combining the first grayscale and a first dithering grayscale based on the first dithering signal DS1. The first target grayscale TG1 may be represented based on a combination of the first grayscale and the first dithering grayscale. The first dithering grayscale may be higher or lower than the first grayscale by about 1 grayscale. For example, when the first grayscale is about 128 grayscale, the first dithering grayscale may be one of about 127 grayscale or about 129 grayscale. When the first grayscale is about 128 grayscale, and when the first target grayscale TG1 is about 128.5 grayscale, the first dithering grayscale may be about 129 grayscale.

The dithering processor 230 may apply the dithering function to the first input pixel data IPD1. The dithering function is used in computer graphics to create the illusion of color depth in images with a limited color palette. In a dithered image, colors that are not available in the palette are approximated by a diffusion of colored pixels from within the available palette. The human eye perceives the diffusion as a mixture of the colors within it. For example, when it is assumed that the display panel 100 displays two-hundred-fifty-six grayscales, which range from about 0 grayscale to about 255 grayscale, about 128.5 grayscale may be represented on the display panel 100 based on a temporal dithering (e.g., a temporal grayscale reconfiguration) where a single pixel alternately and sequentially displays about 128 grayscale and about 129 grayscale, or based on a spatial dithering (e.g., a spatial grayscale reconfiguration) where two adjacent pixels display about 128 grayscale and about 129 grayscale, respectively. In the temporal dithering, about 128.5 grayscale may be represented by the single pixel. In the spatial dithering, about 128.5 grayscale may be represented by the two adjacent pixels. Although 128.5 grayscale is shown for exemplary temporal dithering using two frames, temporal dithering may be used with varying numbers or durations of frames to provide other grayscales, such as 128.25 using four frames or a 25% duration at 128 and a 75% duration at 129 grayscale, for example. In addition, although 128.5 grayscale is shown for exemplary spatial dithering with a two-pixel group, spatial dithering may be used with varying numbers of pixels or sub-pixels per group to provide other grayscales, such as 128.33 using three pixels with two at 128 and one at 129 grayscale, for example. Moreover, temporal and spatial dithering may be combined, such as two pixels spatially dithered with one of those temporally dithered, such as a temporally dithered pixel at 128.5 grayscale combined with two spatially dithered pixels at 129 grayscale for an effective 128.83 grayscale, for example.

The control signal generator 240 may generate the first control signal CONT1 for the gate driver 300, the second control signal CONT2 for the data driver 400 and the third control signal CONT3 for the common voltage generator 500 based on the input control signal ICONT.

In an exemplary embodiment, the above described operation may be performed for each of the plurality of input pixel data other than the first input pixel data IPD1. For example, the grayscale compensator 210 may generate a second target grayscale TG2 based on a second grayscale that corresponds to second input pixel data IPD2 of the second pixel P2. The second pixel P2 may be adjacent to the first pixel P1. The dithering controller 220 may generate a second dithering signal DS2 based on the second grayscale and second common voltage information. The second dithering signal DS2 may indicate a dithering scheme for the second pixel P2. The second common voltage information may indicate whether the reference common voltage VCOM is substantially equal to an optimal common voltage of the second pixel P2. The dithering processor 230 may generate second output pixel data PD2 by combining the second grayscale and a second dithering grayscale based on the second dithering signal DS2. The second target grayscale TG2 may be represented based on a combination of the second grayscale and the second dithering grayscale.

In an exemplary embodiment, the second grayscale, the second target grayscale TG2, the second common voltage information, the second dithering signal DS2 and the second dithering grayscale may be substantially the same as or different from the first grayscale, the first target grayscale TG1, the first common voltage information, the first dithering signal DS1 and the first dithering grayscale, respectively.

Although not illustrated in FIG. 2, the timing controller 200 may further include an element that selectively performs an image quality compensation, a spot compensation, an adaptive color correction (ACC), and/or a dynamic capacitance compensation (DCC) on the plurality of input pixel data IPD1~IPDn.

Although not illustrated in FIGS. 1 and 2, the data driver 400 may generate a first data voltage based on the first output pixel data PD1. The first data voltage may be provided to the first pixel P1. A polarity of the first data voltage may be reversed with respect to the reference common voltage VCOM for each predetermined duration (e.g., at each frame). A phase of the first data voltage may be symmetric or asymmetric with respect to the reference common voltage VCOM depending on the dithering scheme for the first pixel P1. Similarly, the data driver 400 may generate a second data voltage based on the second output pixel data PD2. The second data voltage may be provided to the second pixel P2. A polarity and a phase of the second data voltage may be similar to those of the first data voltage.

FIGS. 3, 4, 5 and 6 are diagrams for describing an operation of a first pixel included in the display apparatus according to an exemplary embodiment.

FIGS. 3, 4, 5 and 6 illustrate examples of the temporal dithering for representing the same target grayscale regardless of a change of the optimal common voltage of the first pixel P1 in FIG. 1. FIGS. 3, 4, 5 and 6 show an example where the first grayscale, the first target grayscale TG1 and the first dithering grayscale are about 128 grayscale, about 128.5 grayscale and about 129 grayscale, respectively.

Figure 3:
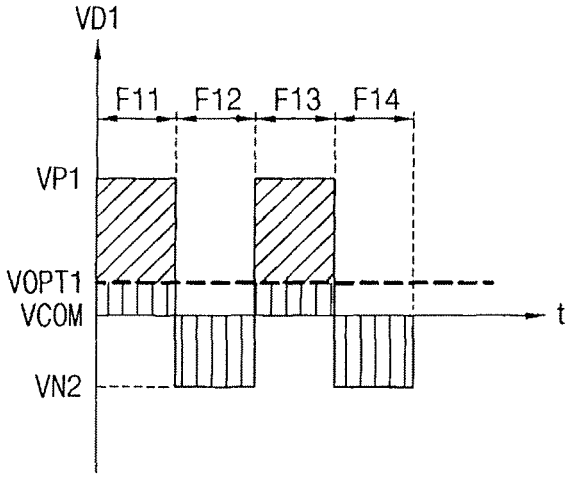
FIGS. 3, 4, 5 and 6 are timing diagrams for describing an operation of a first pixel included in the display apparatus of FIG. 1.
Figure 4:
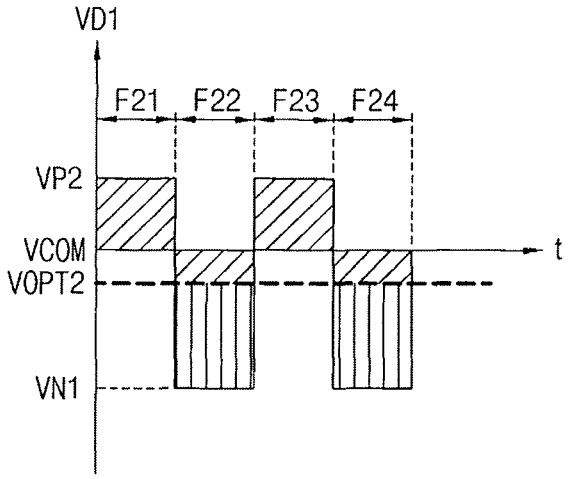

Referring to FIGS. 2, 3 and 4, when a level of the optimal common voltage (e.g., VOPT1 in FIG. 3, or VOPT2 in FIG. 4) of the first pixel P1 is different from a level of the reference common voltage VCOM, the timing controller 200 may set the dithering scheme for the first pixel P1 to the asymmetric dithering scheme (e.g., one of a first dithering scheme and a second dithering scheme). When the first data voltage (e.g., VD1 in FIG. 3 or FIG. 4) is generated based on the asymmetric dithering scheme, the phase of the first data voltage may be asymmetric with respect to the reference common voltage VCOM.

In an exemplary embodiment, as illustrated in FIG. 3, when the level of the optimal common voltage VOPT1 of the first pixel P1 is higher than the level of the reference common voltage VCOM, the first dithering scheme may be set as the dithering scheme for the first pixel P1. The first dithering scheme may be referred to as a positive asymmetric dithering scheme.

When the first data voltage VD1 is generated based on the first dithering scheme, the first data voltage VD1 may have a positive polarity level VP1 during a first frame F11, a negative polarity level VN2 during a second frame F12 subsequent to the first frame F11, the positive polarity level VP1 during a third frame F13 subsequent to the second frame F12, and the negative polarity level VN2 during a fourth frame F14 subsequent to the third frame F13. The positive polarity level VP1 may correspond to the first dithering grayscale (e.g., about 129 grayscale), and the negative polarity level VN2 may correspond to the first grayscale (e.g., about 128 grayscale) that is different from (e.g., lower than) the first dithering grayscale.

In an exemplary embodiment, as illustrated in FIG. 4, when the level of the optimal common voltage VOPT2 of the first pixel P1 is lower than the level of the reference common voltage VCOM, the second dithering scheme may be set as the dithering scheme for the first pixel P1. The second dithering scheme may be referred to as a negative asymmetric dithering scheme.

When the first data voltage VD1 is generated based on the second dithering scheme, the first data voltage VD1 may have a positive polarity level VP2 during a first frame F21, a negative polarity level VN1 during a second frame F22 subsequent to the first frame F21, the positive polarity level VP2 during a third frame F23 subsequent to the second frame F22, and the negative polarity level VN1 during a fourth frame F24 subsequent to the third frame F23. The positive polarity level VP2 may correspond to the first grayscale (e.g., about 128 grayscale), and the negative polarity level VN1 may correspond to the first dithering grayscale (e.g., about 129 grayscale) that is different from (e.g., higher than) the first grayscale.

In the asymmetric dithering scheme, the first pixel P1 may display the first dithering grayscale during two frames (e.g., F11 and F13 in FIG. 3, or F22 and F24 in FIG. 4), and may display the first grayscale during the other two frames (e.g., F12 and F14 in FIG. 3, or F21 and F23 in FIG. 4). Thus, the first target grayscale TG1 (e.g., about 128.5 grayscale) may be represented by the first pixel P1 during four consecutive frames (e.g., F11~F14 in FIG. 3, or F21~F24 in FIG. 4). In addition, in the asymmetric dithering scheme, the phase of the first data voltage VD1 may be asymmetric with respect to the reference common voltage VCOM, but may be symmetric with respect to the optimal common voltage (e.g., VOPT1 in FIG. 3, or VOPT2 in FIG. 4) of the first pixel P1. In other words, a size of a sum of diagonal-lined quadrangles in FIG. 3 may be substantially the same as a size of a sum of vertical-lined quadrangles in FIG. 3, and a size of a sum of diagonal-lined quadrangles in FIG. 4 may be substantially the same as a size of a sum of vertical-lined quadrangles in FIG. 4. Accordingly, the flicker may be reduced or minimized on the display panel 100.

Figure 5:
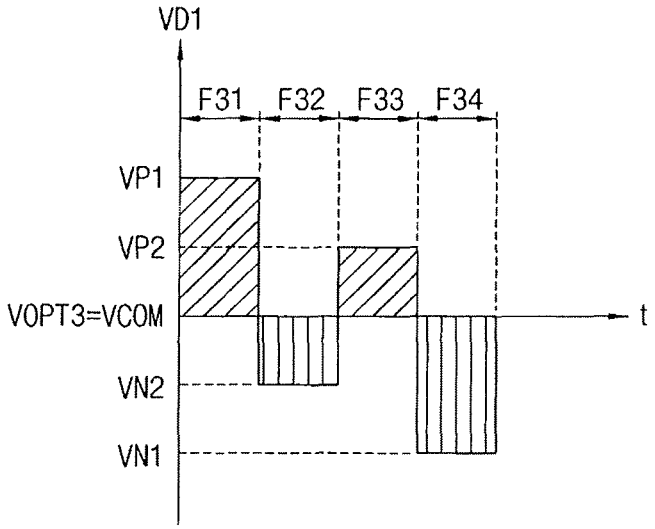
Figure 6:
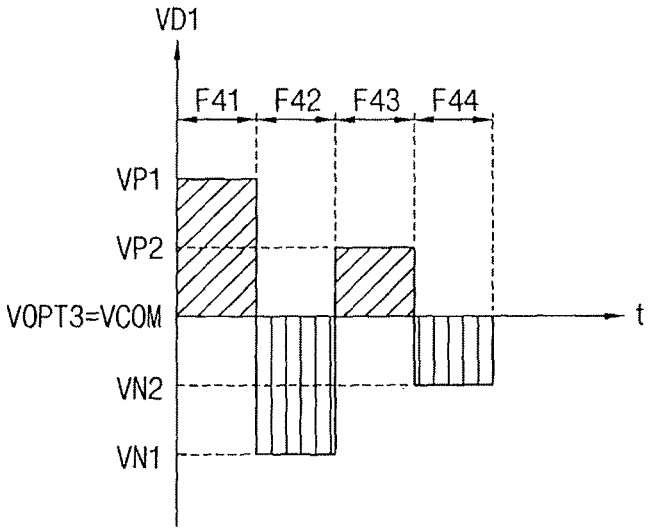

Referring to FIGS. 2, 5 and 6, when a level of the optimal common voltage (e.g., VOPT3 in FIG. 5 or FIG. 6) of the first pixel P1 is substantially equal to a level of the reference common voltage VCOM, the timing controller 200 may set the dithering scheme for the first pixel P1 to the symmetric dithering scheme (e.g., a third dithering scheme). When the first data voltage (e.g., VD1 in FIG. 5 or FIG. 6) is generated based on the symmetric dithering scheme, the phase of the first data voltage may be symmetric with respect to the reference common voltage VCOM.

In an exemplary embodiment, as illustrated in FIG. 5, when the first data voltage VD1 is generated based on the third dithering scheme, the first data voltage VD1 may have a positive polarity level VP1 during a first frame F31, a negative polarity level VN2 during a second frame F32 subsequent to the first frame F31, a positive polarity level VP2 during a third frame F33 subsequent to the second frame F32, and a negative polarity level VN1 during a fourth frame F34 subsequent to the third frame F33. Each of the positive polarity level VP1 and the negative polarity level VN1 may correspond to the first dithering grayscale (e.g., about 129 grayscale), and each of the negative polarity level VN2 and the positive polarity level VP2 may correspond to the first grayscale (e.g., about 128 grayscale) that is different from (e.g., lower than) the first dithering grayscale.

In an exemplary embodiment, as illustrated in FIG. 6, when the first data voltage VD1 is generated based on the third dithering scheme, the first data voltage VD1 may have the positive polarity level VP1 during a first frame F41, the negative polarity level VN1 during a second frame F42 subsequent to the first frame F41, the positive polarity level VP2 during a third frame F43 subsequent to the second frame F42, and the negative polarity level VN2 during a fourth frame F44 subsequent to the third frame F43. Each of the positive polarity level VP1 and the negative polarity level VN1 may correspond to the first dithering grayscale, and each of the negative polarity level VN2 and the positive polarity level VP2 may correspond to the first grayscale.

In the symmetric dithering scheme, the first pixel P1 may display the first dithering grayscale during two frames (e.g., F31 and F34 in FIG. 5, or F41 and F42 in FIG. 6), and may display the first grayscale during the other two frames (e.g., F32 and F33 in FIG. 5, or F43 and F44 in FIG. 6). Thus, the first target grayscale TG1 (e.g., about 128.5 grayscale) may be represented by the first pixel P1 during four consecutive frames (e.g., F31~F34 in FIG. 5, or F41~F44 in FIG. 6). In addition, in the symmetric dithering scheme, the phase of the first data voltage VD1 may be symmetric with respect to the reference common voltage VCOM. In other words, a size of a sum of diagonal-lined quadrangles in FIG. 5 may be substantially the same as a size of a sum of vertical-lined quadrangles in FIG. 5, and a size of a sum of diagonal-lined quadrangles in FIG. 6 may be substantially the same as a size of a sum of vertical-lined quadrangles in FIG. 6.

Although an exemplary embodiment is described based on an example (e.g., the example illustrated in FIGS. 3 through 6) where the first target grayscale TG1 is a middle grayscale of the first grayscale and the first dithering grayscale, alternate embodiments may be employed where the first target grayscale is any real number grayscale between the first grayscale and the first dithering grayscale, and the above described operation may be changed based on the first target grayscale. For example, when the first grayscale and the first dithering grayscale are about 128 grayscale and about 129 grayscale, respectively, the first target grayscale TG1 may be about 128.25 grayscale or about 128.75 grayscale. When the first target grayscale TG1 is about 128.25 grayscale, the first pixel P1 may represent the first target grayscale TG1 by displaying the first grayscale during one of four consecutive frames and by displaying the first dithering grayscale during the other three frames. When the first target grayscale TG1 is about 128.75 grayscale, the first pixel P1 may represent the first target grayscale TG1 by displaying the first dithering grayscale during one of four consecutive frames and by displaying the first grayscale during the other three frames.

FIGS. 7, 8, 9 and 10 are diagrams for describing an operation of a second pixel adjacent to the first pixel and included in the display apparatus according to an exemplary embodiment.

FIGS. 7, 8, 9 and 10 illustrate examples of the temporal dithering for representing the same target grayscale regardless of a change of the optimal common voltage of the second pixel P2 in FIG. 1. FIGS. 7, 8, 9 and 10 for the second pixel may correspond to FIGS. 3, 4, 5 and 6 for the first pixel, respectively. FIGS. 7, 8, 9 and 10 show an example where the optimal common voltage of the second pixel P2, the second grayscale, the second target grayscale TG2 and the second dithering grayscale are substantially the same as the optimal common voltage of the first pixel P1, the first grayscale, the first target grayscale TG1 and the first dithering grayscale, respectively.

Figure 7:
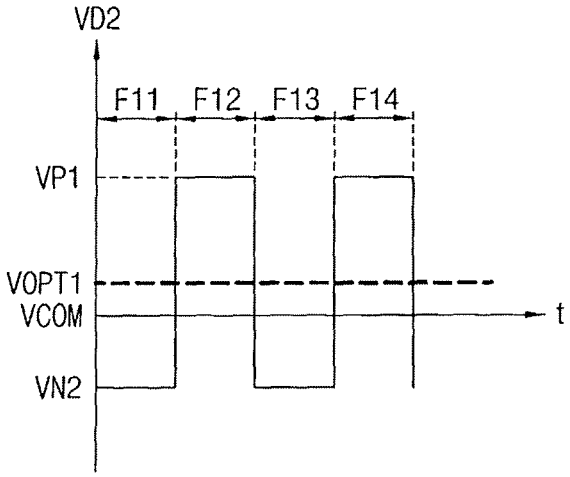
FIGS. 7, 8, 9 and 10 are timing diagrams for describing an operation of a second pixel adjacent to the first pixel and included in the display apparatus of FIG. 1.
Figure 8:
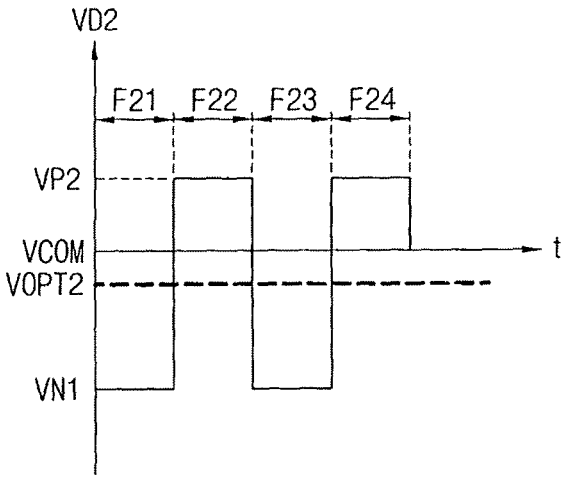

Referring to FIGS. 2, 7 and 8, similar to the dithering scheme for the first pixel P1 in FIGS. 3 and 4, the timing controller 200 may set the dithering scheme for the second pixel P2 to the asymmetric dithering scheme.

In an exemplary embodiment, as illustrated in FIG. 7, when the second data voltage VD2 is generated based on the first dithering scheme, the second data voltage VD2 may have the negative polarity level VN2 during the first frame F11, the positive polarity level VP1 during the second frame F12 subsequent to the first frame F11, the negative polarity level VN2 during the third frame F13 subsequent to the second frame F12, and the positive polarity level VP1 during the fourth frame F14 subsequent to the third frame F13. The negative polarity level VN2 may correspond to the second grayscale (e.g., about 128 grayscale), and the positive polarity level VP1 may correspond to the second dithering grayscale (e.g., about 129 grayscale) that is different from (e.g., higher than) the second grayscale.

In an exemplary embodiment, as illustrated in FIG. 8, when the second data voltage VD2 is generated based on the second dithering scheme, the second data voltage VD2 may have the negative polarity level VN1 during the first frame F21, the positive polarity level VP2 during the second frame F22 subsequent to the first frame F21, the negative polarity level VN1 during the third frame F23 subsequent to the second frame F22, and the positive polarity level VP2 during the fourth frame F24 subsequent to the third frame F23. The negative polarity level VN1 may correspond to the second dithering grayscale, and the positive polarity level VP2 may correspond to the second grayscale that is different from (e.g., lower than) the second dithering grayscale.

In the asymmetric dithering scheme, the second pixel P2 may display the second dithering grayscale during two frames, and may display the second grayscale during the other two frames, and thus the second target grayscale TG2 (e.g., about 128.5 grayscale) may be represented by the second pixel P2 during four consecutive frames. In the asymmetric dithering scheme, the phase of the second data voltage VD2 may be symmetric with respect to the optimal common voltage of the second pixel P2, and thus the flicker may be reduced or minimized on the display panel 100. In addition, two adjacent pixels P1 and P2 may alternately display the first and second grayscales and the first and second dithering grayscales, respectively, and thus the temporal dithering and the spatial dithering may be substantially simultaneously (or concurrently) performed.

Figure 9:
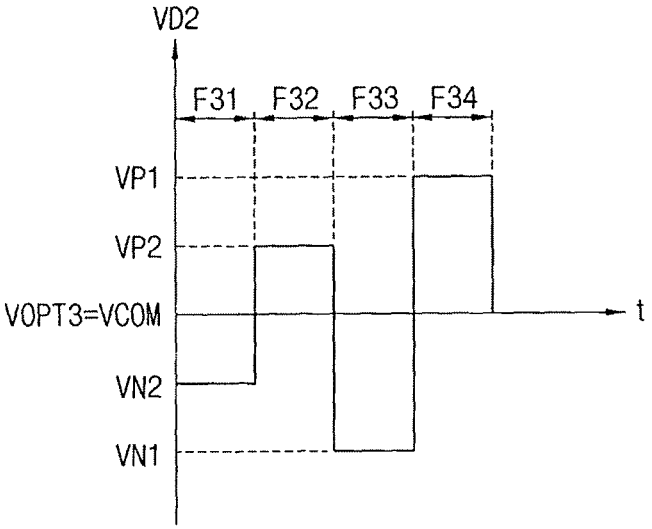
Figures 10, 11:
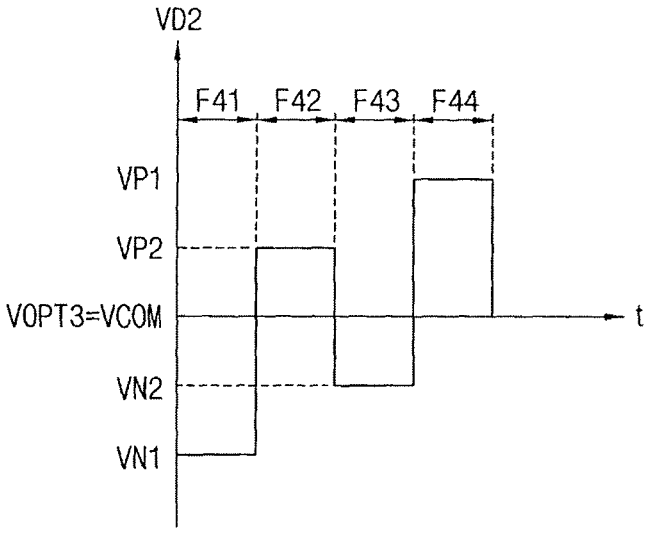
FIG. 11 is a table illustrating an example of a lookup table stored in the timing controller of FIG. 2.

Referring to FIGS. 2, 9 and 10, similar to the dithering scheme for the first pixel P1 in FIGS. 5 and 6, the timing controller 200 may set the dithering scheme for the second pixel P2 to the symmetric dithering scheme.

In an exemplary embodiment, as illustrated in FIG. 9, when the second data voltage VD2 is generated based on the third dithering scheme, the second data voltage VD2 may have the negative polarity level VN2 during the first frame F31, the positive polarity level VP2 during the second frame F32 subsequent to the first frame F31, the negative polarity level VN1 during the third frame F33 subsequent to the second frame F32, and the positive polarity level VP1 during the fourth frame F34 subsequent to the third frame F33. Each of the negative polarity level VN2 and the positive polarity level VP2 may correspond to the second grayscale (e.g., about 128 grayscale), and each of the negative polarity level VN1 and the positive polarity level VP1 may correspond to the second dithering grayscale (e.g., about 129 grayscale) that is different from (e.g., higher than) the second grayscale.

In an exemplary embodiment, as illustrated in FIG. 10, when the second data voltage VD2 is generated based on the third dithering scheme, the second data voltage VD2 may have the negative polarity level VN1 during the first frame F41, the positive polarity level VP2 during the second frame F42 subsequent to the first frame F41, the negative polarity level VN2 during the third frame F43 subsequent to the second frame F42, and the positive polarity level VP1 during the fourth frame F44 subsequent to the third frame F43. Each of the negative polarity level VN1 and the positive polarity level VP1 may correspond to the second dithering grayscale, and each of the positive polarity level VP2 and the negative polarity level VN2 may correspond to the second grayscale.

In the symmetric dithering scheme, the second pixel P2 may display the second dithering grayscale during two frames, and may display the second grayscale during the other two frames, and thus the second target grayscale TG2 (e.g., about 128.5 grayscale) may be represented by the second pixel P2 during four consecutive frames. In the symmetric dithering scheme, the phase of the second data voltage VD2 may be symmetric with respect to the reference common voltage VCOM. In addition, two adjacent pixels P1 and P2 may alternately display the first and second grayscales and the first and second dithering grayscales, respectively, and thus the temporal dithering and the spatial dithering may be substantially simultaneously performed.

FIG. 11 is a table illustrating an example of a lookup table stored in the timing controller of FIG. 2.

Referring to FIGS. 1, 2 and 11, the first lookup table LUT1 may include a plurality of input grayscales, a plurality of target grayscales corresponding to the input grayscales, and common voltage information for the input grayscales.

In an exemplary embodiment, the first common voltage information, which indicates whether the reference common voltage VCOM is substantially equal to the optimal common voltage of the first pixel P1, may vary depending on the first grayscale corresponding to the first input pixel data IPD1. In other words, the optimal common voltage of the first pixel P1 may vary depending on the first grayscale corresponding to the first input pixel data IPD1.

For example, when the first grayscale may be about 2 grayscale, the optimal common voltage of the first pixel P1 may be unequal to the reference common voltage VCOM, and may be higher than the reference common voltage VCOM, and then the first common voltage information may indicate a first condition for asymmetric POSitive Dithering (POSD). Thus, the dithering controller 220 may generate the first dithering signal DS1 indicating the first dithering scheme, and the dithering processor 230 may apply the dithering function to the first input pixel data IPD1 based on, e.g., the example of FIG. 3.

For another example, when the first grayscale may be about 128 grayscale, the optimal common voltage of the first pixel P1 may be unequal to the reference common voltage VCOM, and may be lower than the reference common voltage VCOM, and then the first common voltage information may indicate a second condition for asymmetric NEGative Dithering (NEGD). Thus, the dithering controller 220 may generate the first dithering signal DS1 indicating the second dithering scheme, and the dithering processor 230 may apply the dithering function to the first input pixel data IPD1 based on, e.g., the example of FIG. 4.

For still another example, when the first grayscale may be about 0 grayscale, the optimal common voltage of the first pixel P1 may be equal to the reference common voltage VCOM, and then the first common voltage information may indicate a third condition for symmetric, or neither positive NOR negative, Dithering (NORD). Thus, the dithering controller 220 may generate the first dithering signal DS1 indicating the third dithering scheme, and the dithering processor 230 may apply the dithering function to the first input pixel data IPD1 based on, e.g., the example of FIG. 5 or FIG. 6.

Figure 12:
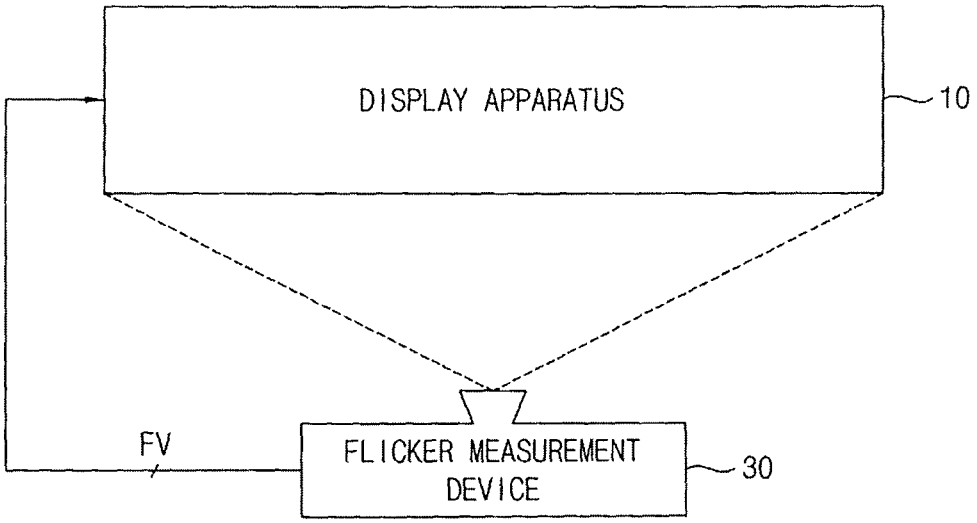
FIG. 12 is a block diagram illustrating a flicker measurement device to measure flicker levels of the display apparatus of FIG. 1.

FIG. 12 is a block diagram illustrating a flicker measurement device to measure flicker levels of the display apparatus according to an exemplary embodiment.

Referring to FIGS. 1, 2 and 12, when the display apparatus 10 is manufactured, a plurality of flicker levels FV may be obtained from an external flicker measurement device 30. For example, a relationship between a plurality of grayscales and a plurality of flicker levels corresponding to the plurality of grayscales and/or a relationship between a plurality of locations in the display panel 100 and a plurality of flicker levels corresponding to the plurality of locations may be obtained in real time by displaying test images on the display panel 100 and by measuring flicker levels of the display panel 100 based on the test images.

In an exemplary embodiment, the common voltage information, which indicates whether the reference common voltage VCOM is substantially equal to the optimal common voltage, may be generated based on the plurality of flicker levels FV. For example, when the plurality of flicker levels FV are equal to or higher than a reference flicker level, it may be determined that the reference common voltage VCOM is not equal to the optimal common voltage, and thus the common voltage information may be set to the first condition (e.g., POSD in FIG. 11) or the second condition (e.g., NEGD in FIG. 11). When the plurality of flicker levels FV are lower than the reference flicker level, it may be determined that the reference common voltage VCOM is equal to the optimal common voltage, and thus the common voltage information may be set to the third condition (e.g., NORD in FIG. 11).

In an exemplary embodiment, the display apparatus 10 may be temporarily connected to the flicker measurement device 30 and may receive the plurality of flicker levels FV from the flicker measurement device 30. For example, the display apparatus 10 may communicate with the flicker measurement device 30 using a protocol between communication interfaces, based on, for example, an Inter-Integrated Circuit (I2C) interface. When the setting of the common voltage information is completed, the flicker measurement device 30 may be separated from the display apparatus 10.

Although not illustrated in FIGS. 1, 2 and 12, the common voltage information may be obtained based on feedback of the reference common voltage VCOM (e.g., by retrieving the reference common voltage VCOM that is provided to the display panel 100).

Hereinafter, an operation of the display apparatus 10 according to an exemplary embodiment will be described in detail based on two pixels (e.g., P1 and P3 in FIG. 14) that are spaced apart from each other in the display panel 100.

Figure 13:
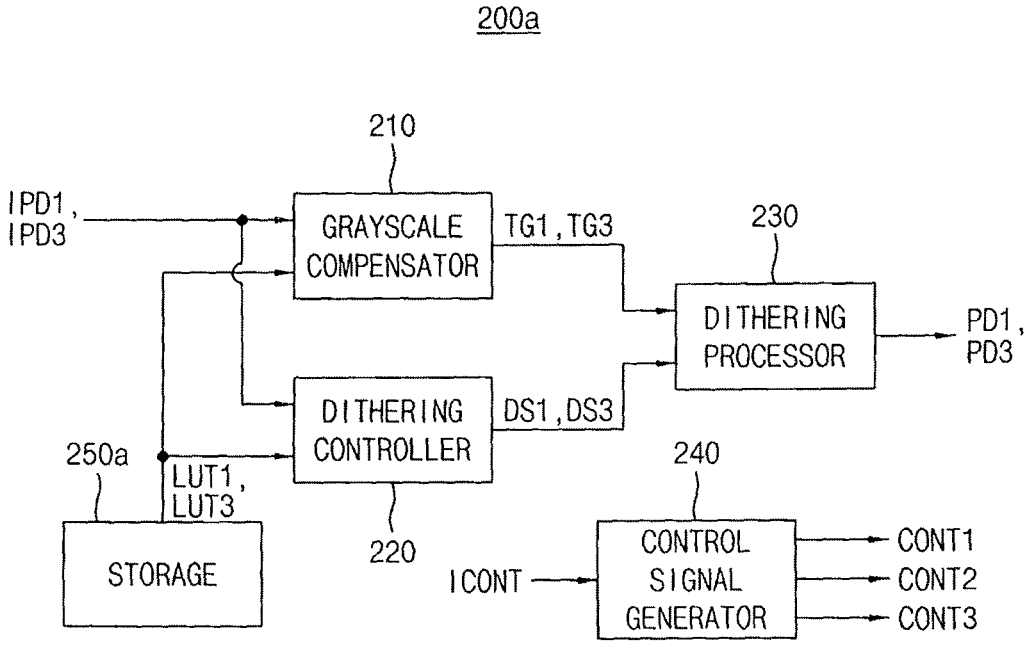
FIG. 13 is a block diagram illustrating a timing controller included in the display apparatus of FIG. 1.
Figure 14:
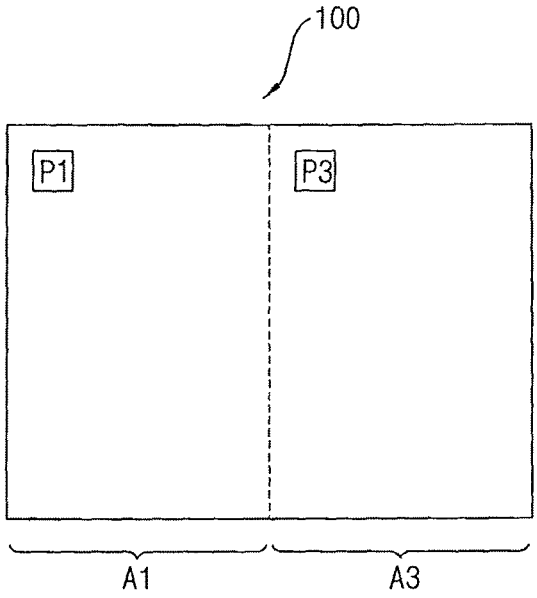
FIG. 14 is a block diagram illustrating a display panel included in the display apparatus of FIG. 1.

FIG. 13 is a block diagram illustrating a timing controller included in the display apparatus according to an exemplary embodiment. FIG. 14 is a block diagram illustrating a display panel included in the display apparatus according to an exemplary embodiment.

Referring to FIGS. 1, 13 and 14, a timing controller 200*a* may include a grayscale compensator 210, a dithering controller 220 and a dithering processor 230. The timing controller 200*a* may further include a control signal generator 240 and a storage 250*a*.

The timing controller 200*a* of FIG. 13 may be substantially the same as the timing controller 200 of FIG. 2, except that at least one lookup table stored in the storage 250*a* is changed or added for the third pixel P3, and signals and/or data generated by the grayscale compensator 210, the dithering controller 220 and the dithering processor 230 are changed or added for the third pixel P3.

The display panel 100 may be divided into a plurality of display regions. For example, as illustrated in FIG. 2, the display panel 100 may include a first display region A1 and a second display region A2. The first pixel P1 may be included in the first display region A1, and a third pixel P3 may be included in the second display region A2.

The grayscale compensator 210 may generate a first target grayscale TG1 based on a first grayscale that corresponds to first input pixel data IPD1 of the first pixel P1, and may generate a third target grayscale TG3 based on a third grayscale that corresponds to third input pixel data IPD3 of the third pixel P3. The dithering controller 220 may generate a first dithering signal DS1 based on the first grayscale and first common voltage information, and may generate a third dithering signal DS3 based on the third grayscale and third common voltage information. The first dithering signal DS1 may indicate a dithering scheme for the first pixel P1, and the third dithering signal DS3 may indicate a dithering scheme for the third pixel P3. The first common voltage information may indicate whether the reference common voltage VCOM is substantially equal to an optimal common voltage of the first pixel P1, and the third common voltage information may indicate whether the reference common voltage VCOM is substantially equal to an optimal common voltage of the third pixel P3.

The storage 250 may store a first lookup table LUT1 and a second lookup table LUT3. The first lookup table LUT1 and the second lookup table LUT3 may correspond to the first display region A1 and the second display region A2, respectively. Each of the lookup tables LUT1 and LUT3 may include a plurality of input grayscales, a plurality of target grayscales corresponding to the input grayscales, and common voltage information for the input grayscales. The grayscale compensator 210 and the dithering controller 220 may generate the first target grayscale TG1 and the first dithering signal DS1 by searching the first lookup table LUT1, and may generate the third target grayscale TG3 and the third dithering signal DS3 by searching the second lookup table LUT3.

The dithering processor 230 may generate first output pixel data PD1 based on the first target grayscale TG1 and the first dithering signal DS1, and may generate third output pixel data PD3 based on the third target grayscale TG3 and the third dithering signal DS3.

Figure 15:
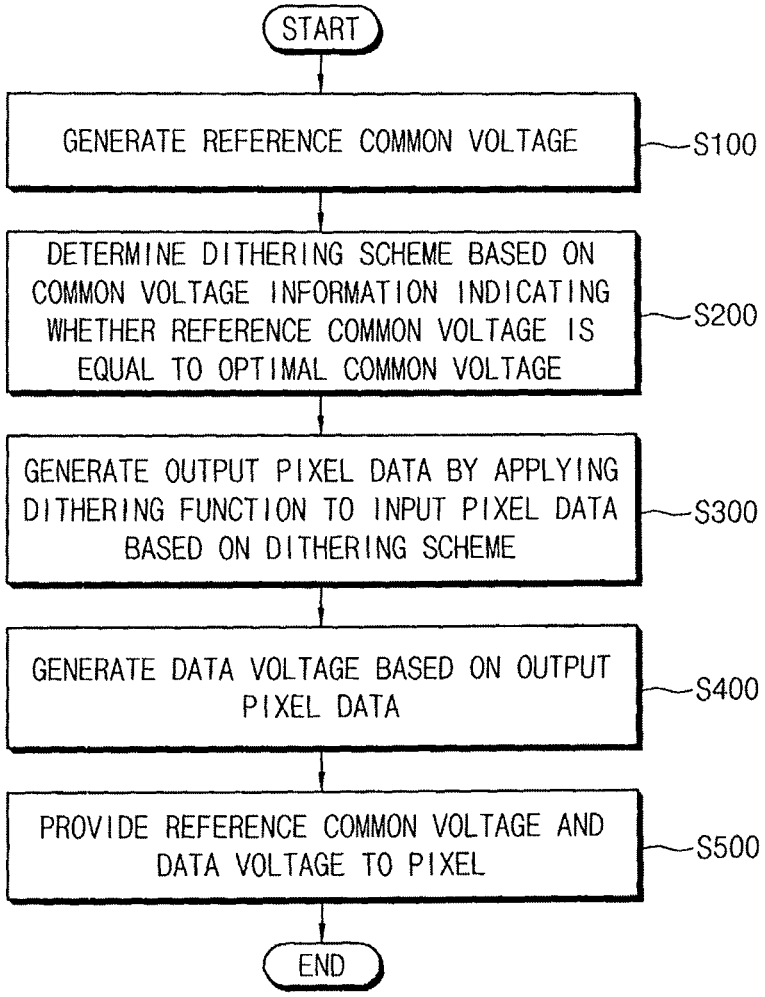
FIG. 15 is a flow chart illustrating a method of operating a display apparatus according to an exemplary embodiment.
Figure 16:
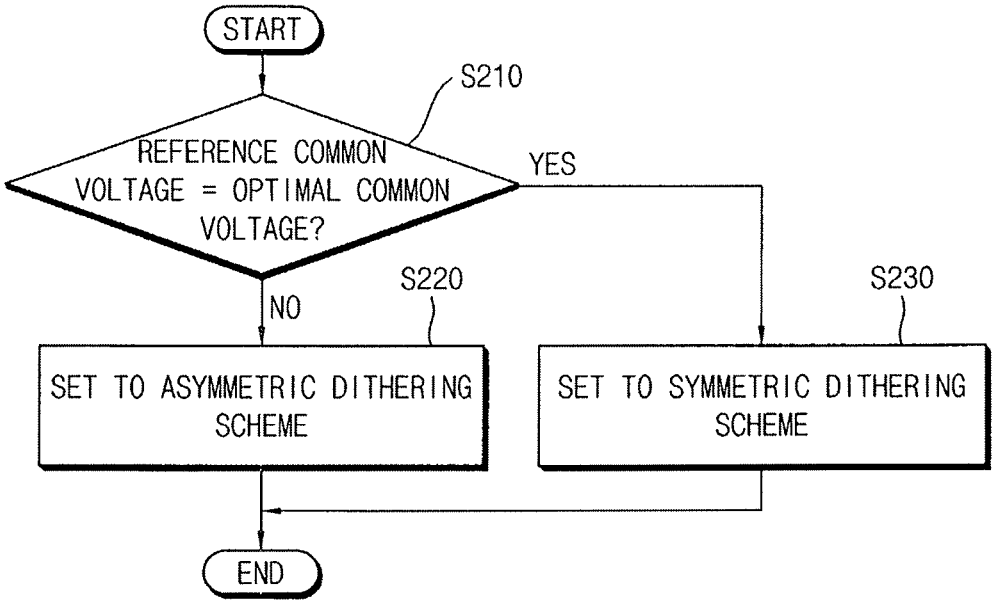
FIG. 16 is a flow chart illustrating an example of step S200 in FIG. 15.

FIG. 15 is a flow chart illustrating a method of operating a display apparatus according to an exemplary embodiment. FIG. 16 is a flow chart illustrating an example of step S200 in FIG. 15.

Referring to FIGS. 1, 15 and 16, in a method of operating the display apparatus 10 according to an exemplary embodiment, the common voltage generator 500 generates the reference common voltage VCOM (step S100).

The timing controller 200 determines a dithering scheme for the display panel 100 based on common voltage information that indicate whether the reference common voltage VCOM is substantially equal to an optimal common voltage (step S200). When the reference common voltage VCOM is not equal to the optimal common voltage (step S210: NO), the dithering scheme may be set to the asymmetric dithering scheme (step S220). When the reference common voltage VCOM is equal to the optimal common voltage (step S210: YES), the dithering scheme may be set to the symmetric dithering scheme (step S230).

In an exemplary embodiment, the dithering scheme may be determined for each pixel or each display region. In addition, the dithering scheme may be changed depending on a change of grayscales and/or a change of locations in the display panel 100. As described above with reference to FIG. 12, the common voltage information may be generated based on the plurality of flicker levels FV that are obtained from the external flicker measurement device 30.

The timing controller 200 generates the output pixel data PD1~PDn by applying the dithering function to the input pixel data IPD1~IPDn based on the determined dithering scheme (step S300).

The data driver 400 generates the data voltages based on the output pixel data PD1~PDn (step S400). For example, each data voltage that is generated based on the asymmetric dithering scheme may have a phase that is asymmetric with respect to the reference common voltage VCOM (e.g., in the examples of FIGS. 3, 4, 7 and 8). Each data voltage that is generated based on the symmetric dithering scheme may have a phase that is symmetric with respect to the reference common voltage VCOM (e.g., in the examples of FIGS. 5, 6, 9 and 10).

The data driver 400 and the common voltage generator 500 provide the data voltages and the reference common voltage VCOM to the display panel 100, respectively (step S500). Although not illustrated in FIG. 1, a single pixel (e.g. the pixel P1) may include a switching element, a pixel electrode and a common electrode. Each data voltage may be provided to the pixel electrode, and the reference common voltage VCOM may be provided to the common electrode.

Although exemplary embodiments are described based on examples of specific asymmetric dithering scheme (e.g., FIGS. 3, 4, 7 and 8) and examples of specific symmetric dithering scheme (e.g., FIGS. 5, 6, 9 and 10), the inventive concept may be applied to an alternate embodiment where a display apparatus operates based on at least one of an asymmetric dithering scheme and at least one of a symmetric dithering scheme.

The above described embodiments may be used in a display apparatus and/or a system including a display apparatus, such as a mobile phone, a smart phone, a personal digital assistant (PDA), a portable multimedia player (PMP), a digital camera, a digital television, a set-top box, a music player, a portable game console, a navigation device, a personal computer (PC), a server computer, a workstation, a tablet computer, a laptop computer, a smart card, a printer, etc.

The foregoing is illustrative of exemplary embodiments of the present inventive concept and is not to be construed as limited to the specific exemplary embodiments disclosed, and that modifications to the disclosed exemplary embodiments, as well as other embodiments, are intended to be included within the scope of the appended claims.

What is claimed is:

1. A display apparatus comprising:

a display panel including a first pixel;

a common voltage generator configured to generate a reference common voltage, and configured to provide the reference common voltage to the first pixel; and a timing controller configured to determine a dithering scheme for the first pixel based on first common voltage information, and configured to generate first output pixel data by applying a dithering function to first input pixel data based on the dithering scheme for the first pixel, the first common voltage information indicating whether the reference common voltage is less than, greater than, or substantially equal to an optimal common voltage of the first pixel, wherein a first data voltage provided to the first pixel is generated based on the first output pixel data, a polarity of the first data voltage is reversed with respect to the reference common voltage for each frame, and a phase of the first data voltage is symmetric or asymmetric with respect to the reference common voltage depending on the dithering scheme for the first pixel.

2. The display apparatus of claim 1, wherein when the optimal common voltage of the first pixel is different from the reference common voltage, the timing controller sets the dithering scheme for the first pixel to one of a first dithering scheme and a second dithering scheme, and wherein when the first data voltage is generated based on one of the first and second dithering schemes, the phase of the first data voltage is asymmetric with respect to the reference common voltage.

3. The display apparatus of claim 2, wherein when the optimal common voltage of the first pixel is higher than the reference common voltage, the first dithering scheme is set as the dithering scheme for the first pixel, wherein the first data voltage generated based on the first dithering scheme has a first positive polarity level during a first frame, a first negative polarity level during a second frame subsequent to the first frame, the first positive polarity level during a third frame subsequent to the second frame, and the first negative polarity level during a fourth frame subsequent to the third frame, and wherein the first positive polarity level corresponds to a first grayscale, and the first negative polarity level corresponds to a second grayscale lower than the first grayscale.

4. The display apparatus of claim 3, wherein the display panel further includes a second pixel adjacent to the first pixel, wherein when the first dithering scheme is set as the dithering scheme for the first pixel, the first dithering scheme is also set as a dithering scheme for the second pixel, wherein a second data voltage provided to the second pixel is generated based on the first dithering scheme, and wherein the second data voltage has the first negative polarity level during the first frame, the first positive polarity level during the second frame, the first negative polarity level during the third frame, and the first positive polarity level during the fourth frame.

5. The display apparatus of claim 2, wherein when the optimal common voltage of the first pixel is lower than the reference common voltage, the second dithering scheme is set as the dithering scheme for the first pixel, wherein the first data voltage generated based on the second dithering scheme has a first positive polarity level during a first frame, a first negative polarity level during a second frame subsequent to the first frame, the first positive polarity level during a third frame subsequent to the second frame, and the first negative polarity level during a fourth frame subsequent to the third frame, and wherein the first positive polarity level corresponds to a first grayscale, and the first negative polarity level corresponds to a second grayscale higher than the first grayscale.

6. The display apparatus of claim 2, wherein when the optimal common voltage of the first pixel is substantially equal to the reference common voltage, the timing controller sets the dithering scheme for the first pixel to a third dithering scheme, and wherein when the first data voltage is generated based on the third dithering schemes, the phase of the first data voltage is symmetric with respect to the reference common voltage.

7. The display apparatus of claim 6, wherein the first data voltage generated based on the third dithering scheme has a first positive polarity level during a first frame, a first negative polarity level during a second frame subsequent to the first frame, a second positive polarity level during a third frame subsequent to the second frame, and a second negative polarity level during a fourth frame subsequent to the third frame, and wherein each of the first positive polarity level and the second negative polarity level corresponds to a first grayscale, and each of the first negative polarity level and the second positive polarity level corresponds to a second grayscale lower than the first grayscale.

8. The display apparatus of claim 6, wherein the first data voltage generated based on the third dithering scheme has a first positive polarity level during a first frame, a first negative polarity level during a second frame subsequent to the first frame, a second positive polarity level during a third frame subsequent to the second frame, and a second negative polarity level during a fourth frame subsequent to the third frame, and wherein each of the first positive polarity level and the first negative polarity level corresponds to a first grayscale, and each of the second positive polarity level and the second negative polarity level corresponds to a second grayscale lower than the first grayscale.

9. The display apparatus of claim 1, wherein the timing controller includes:

a grayscale compensator configured to generate a first target grayscale based on a first grayscale corresponding to the first input pixel data;

a dithering controller configured to generate a first dithering signal based on the first grayscale and the first common voltage information, the first dithering signal indicating the dithering scheme for the first pixel; and a dithering processor configured to generate the first output pixel data by combining the first grayscale and a second grayscale based on the first dithering signal, the first target grayscale being represented based on a combination of the first and second grayscales.

10. The display apparatus of claim 9, wherein a relationship of the first grayscale, the first target grayscale and the first common voltage information is stored as a lookup table.

11. The display apparatus of claim 10, wherein the first common voltage information is generated based on flicker levels that are obtained by an external flicker measurement device.

12. The display apparatus of claim 1, wherein the first common voltage information varies depending on a first grayscale corresponding to the first input pixel data.

13. The display apparatus of claim 1, wherein the first common voltage information varies depending on a location of the first pixel in the display panel.

14. A method of operating a display apparatus, the method comprising: generating a reference common voltage;

determining a dithering scheme for a first pixel based on first common voltage information, the first pixel being included in a display panel, the first common voltage information indicating whether the reference common voltage is less than, greater than, or substantially equal to an optimal common voltage of the first pixel;

generating first output pixel data by applying a dithering function to first input pixel data based on the dithering scheme for the first pixel;

generating a first data voltage based on the first output pixel data; and providing the reference common voltage and the first data voltage to the first pixel, wherein a polarity of the first data voltage is reversed with respect to the reference common voltage for each frame, and a phase of the first data voltage is symmetric or asymmetric with respect to the reference common voltage depending on the dithering scheme for the first pixel.

15. The method of claim 14, wherein when the optimal common voltage of the first pixel is different from the reference common voltage, the dithering scheme for the first pixel is set to one of a first dithering scheme and a second dithering scheme, and wherein when the first data voltage is generated based on one of the first and second dithering schemes, the phase of the first data voltage is asymmetric with respect to the reference common voltage.

16. The method of claim 15, wherein when the optimal common voltage of the first pixel is higher than the reference common voltage, the first dithering scheme is set as the dithering scheme for the first pixel, wherein the first data voltage generated based on the first dithering scheme has a first positive polarity level during a first frame, a first negative polarity level during a second frame subsequent to the first frame, the first positive polarity level during a third frame subsequent to the second frame, and the first negative polarity level during a fourth frame subsequent to the third frame, and wherein the first positive polarity level corresponds to a first grayscale, and the first negative polarity level corresponds to a second grayscale lower than the first grayscale.

17. The method of claim 15, wherein when the optimal common voltage of the first pixel is lower than the reference common voltage, the second dithering scheme is set as the dithering scheme for the first pixel, wherein the first data voltage generated based on the second dithering scheme has a first positive polarity level during a first frame, a first negative polarity level during a second frame subsequent to the first frame, the first positive polarity level during a third frame subsequent to the second frame, and the first negative polarity level during a fourth frame subsequent to the third frame, and wherein the first positive polarity level corresponds to a first grayscale, and the first negative polarity level corresponds to a second grayscale higher than the first grayscale.

18. The method of claim 15, wherein when the optimal common voltage of the first pixel is substantially equal to the reference common voltage, the dithering scheme for the first pixel is set to a third dithering scheme, and wherein when the first data voltage is generated based on the third dithering scheme, the phase of the first data voltage is symmetric with respect to the reference common voltage.

19. The method of claim 14, wherein the first common voltage information varies depending on a first grayscale corresponding to the first input pixel data.

20. The method of claim 15, wherein the first common voltage information varies depending on a location of the first pixel in the display panel.

* * * * *